United States Patent [19]

Whiteley

[11] Patent Number: 5,036,830

[45] Date of Patent: Aug. 6, 1991

[54] METHOD AND APPARATUS FOR BURNING STACKED NEWSPAPERS IN A FIREPLACE OR STOVE

[76] ,Inventor: Isaac C. Whiteley, 13007 NE. Gleason, Portland, Oreg. 97230

[21] Appl. No.: 599,077

[22] Filed: Oct. 17, 1990

[51] Int. Cl.[5] ..... F23H 1/02

[52] U.S. Cl. ..... 126/163 R; 126/516; 126/521

[58] Field of Search ..... 126/518, 516, 517, 163 R, 126/298, 152 B, 152 A, 540

[56] References Cited

U.S. PATENT DOCUMENTS

| | | | |
|---|---|---|---|
| 4,074,681 | 2/1978 | Whiteley | 126/163 R |
| 4,213,445 | 7/1980 | Mayo | 126/518 |
| 4,248,205 | 2/1981 | Saunders | 126/518 |
| 4,771,760 | 9/1988 | Whiteley | 126/298 |
| 4,773,387 | 9/1988 | Zulkowitz | 126/152 B |

*Primary Examiner*—James C. Yeung

*Attorney, Agent, or Firm*—Epstein, Edell & Retzer

[57] ABSTRACT

A method and apparatus for burning a stack of newspapers in a fireplace or stove includes a firebox positionable in a fireplace or stove and having a floor for horizontally supporting a stack of newspapers and an air supply unit for directing a flow of air angularly onto the floor to flow around the sides of the stack and obtain burning of the outer surface of the stack.

20 Claims, 1 Drawing Sheet

METHOD AND APPARATUS FOR BURNING STACKED NEWSPAPERS IN A FIREPLACE OR STOVE

BACKGROUND OF THE INVENTION

1. Field Of The Invention

The invention relates to burning a combustible material to obtain heat and, more particularly, to a method and apparatus for burning newspapers in a fireplace or stove to generate radiant heat.

2. Description Of The Prior Art

The escalating scarcity and cost of conventional energy sources for providing heat, such as oil, electricity and natural gas, have prompted a search for more abundant, cost-effective alternatives. Predictions of future shortages of natural resources and increasing dependence on foreign producers of scarce resources has further intensified efforts to identify alternative energy sources for heating and to implement conservation measures. Fireplaces and wood burning stoves, therefore, have gained in popularity as a source of heat to replace or supplement that supplied by utilities. However, wood itself is rapidly becoming a scarce resource, and the use of wood for burning in fireplaces and stoves depletes existing forests at a rate that outpaces renewal and creates undesirable ecological imbalances. Furthermore, wood is relatively expensive in relation to the amount of heat delivered by a fireplace due to the flames being quite small and supplying only limited radiant heat. Additionally, the efficiency of fireplaces is generally low because air drawn into the fireplace from the surrounding room escapes via the damper through the chimney and, therefore, there is little heat convection into the room.

Various attempts have been made to improve the efficiency of fireplaces by directing heated air into the room and by utilizing different fuels. Although combustible wood substitutes are commercially available for burning in fireplaces, these substitutes burn quickly, are very expensive and cannot be relied upon as a source of radiant heat. It has also been proposed to burn newspapers in a fireplace to obtain heat, since newspapers are a plentiful waste material that must be disposed of after use and such disposal presents a significant waste management burden. Generally, conventional methods and apparatus for burning newspapers involve rolling the newspapers to simulate logs and then burning the logs. Such logs, however, do not burn efficiently for long periods and fail to produce more than minimal radiant heat because ash produced by the logs tends to smother the fire after only a short period of burning time. Additionally, a further disadvantage of newspaper logs is that they produce significant smoke and residue during burning that limits their residential use. Devices for burning newspapers arranged in a stack have also been proposed, and illustrative devices are shown in U.S. Pat. Nos. 4,771,760 to Whiteley and 4,519,378 to Mims, and Canadian patent 1,197,744 to Lawrence. Conventional devices for burning a stack of newspapers typically inject a stream of air directly onto the newspaper stack to facilitate burning, and these devices generally require the stack of newspapers to be supported in an inclined position, such that air directed on the front face of the stack separates the sheets of newspapers to obtain page by page burning. Conventional devices share numerous structural and functional disadvantages, such as the need for specialized support mechanisms to orient the newspaper stack in an inclined position. Additionally, the stack of newspapers tends to burn very rapidly due to the air passing very quickly into the interior of the stack, and sustained heat is not obtained. Furthermore, a large amount of ash is generated that tends to smother the fire, and the air blowing directly on the newspaper stack can itself extinguish the fire. Incomplete burning, therefore, is a common occurrence in conventional devices and these devices demand constant attention and frequent relighting.

SUMMARY OF THE INVENTION

Accordingly, it is an object of the present invention to obtain increased radiant heat from burning newspapers.

It is also an object of the invention to burn a horizontally supported stack of newspapers in a fireplace or stove.

A further object of the invention is to burn a stack of newspapers for a relatively longer period of time.

Another object of the invention is to achieve complete burning of a stack of newspapers.

Additionally, it is an object of the invention to burn a stack of newspapers with relatively little ash or residue production.

A still further object of the invention is to burn a stack of newspapers along the outer face of the stack.

Moreover, it is an object of the invention to burn a stack of newspapers from the outside to the inside of the stack.

These and other objects, attributes and benefits are achieved with the present invention as characterized by a firebox positionable in a fireplace or stove and having upstanding spaced side walls and a rear wall joined to a floor for horizontally supporting a stack of newspapers centrally positioned in the firebox. The firebox includes an open front end, and a discharge passage is disposed adjacent the front end to be centrally positioned between the side walls for discharging into the firebox air received from an air supply unit that draws in room or outside air. A deflector mounted over the discharge opening directs the stream of discharged air angularly onto the floor of the firebox to flow around the stack and obtain burning of the outer surface, or face, of the stack and to sweep ash and residue from the floor.

BRIEF DESCRIPTION OF THE DRAWINGS

These and other objects, features and many of the attendant advantages of the present invention will be appreciated more readily as they become better understood from a reading of the following description considered in connection with the accompanying drawings wherein like parts in each of the several figures are identified by the same reference characters, and wherein.

DESCRIPTION OF THE PREFERRED EMBODIMENT

Figure 1:
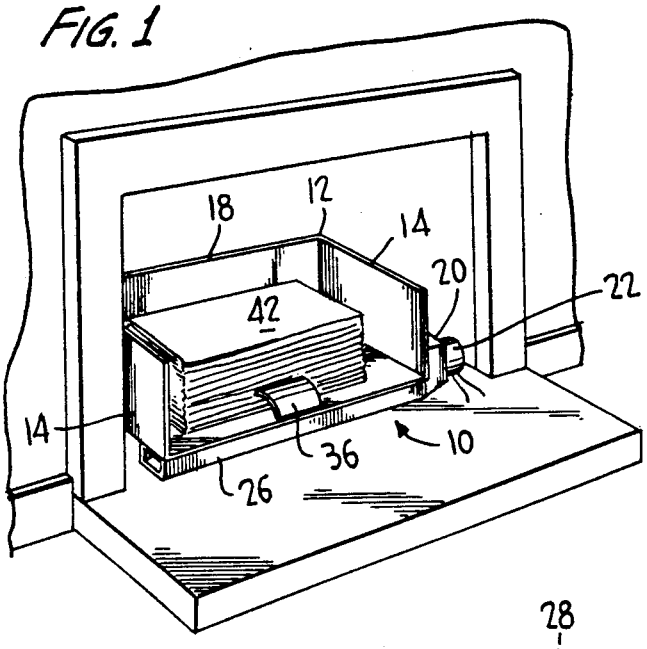
FIG. 1 is a perspective view of the apparatus of the present invention.
Figure 2:
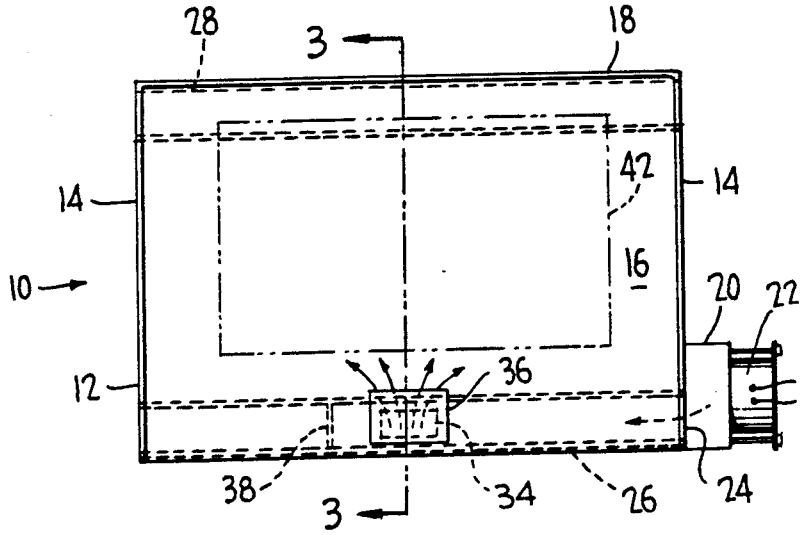
FIG. 2 is a top plan view of the apparatus of the present invention.
Figure 3:
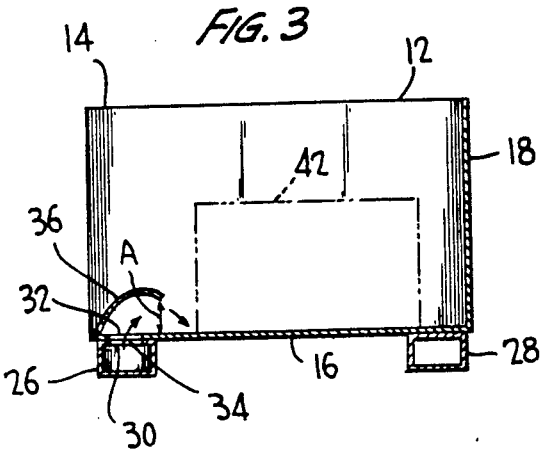
FIG. 3 is a side cross-sectional view of the apparatus of the present invention taken along line 3—3 of FIG. 2.

As shown in FIGS. 1–3, an apparatus 10 for burning stacked newspapers according to the present invention includes a firebox 12 having opposed, upstanding, parallel spaced side walls 14 joined at their bottom edges to a horizontally oriented floor 16 and at their rear edges to an upstanding rear wall 18 having its bottom edge joined to floor 16. An air supply unit 20 including a fan or blower 22 is mounted on a side wall 14 to be positioned exteriorly of the firebox, and a discharge outlet of blower 22 communicates with an open end 24 of a manifold tube 26 disposed beneath floor 16. Manifold tube 26 is secured to floor 16 to extend laterally between side walls 14 adjacent the front edge of the floor 16, and a channel 28 is similarly disposed beneath floor 16 to extend laterally between side walls 14 adjacent the rear edge of the floor to allow the firebox to be supported by tube 26 and channel 28 on a support surface in spaced relation thereto.

A slot 30 is formed in tube 26 adjacent the front edge of floor 16 to be centrally positioned between side walls 14, and an opening 32 is formed in floor 16 in vertical alignment with slot 30 to define a passage 34 establishing communication between the interior of tube 26 and the firebox 12. A deflector 36 is secured to the forwardmost edge 36 of passage 34 and includes a curved body extending over passage 34 and defining an arc of a circle having a center disposed on floor 16 and a radius contained in a vertical plane perpendicularly intersecting floor 16 parallel to sides 14, as shown in FIGS. 2 and 3. As shown in FIG. 2, a baffle 38 is disposed in tube 26 adjacent slot 30, such that air flowing through tube 26 is forced through slot 30 and, therefore, passage 34.

Firebox 12 is preferably made of steel and is sized and configured to be positioned in conventional fireplaces, masonry or zero clearance, as well as stoves. Preferably, side walls 14, floor 16 and rear wall 18 are fabricated of eleven gauge steel panels, and the edges of the panels are joined by welding. According to a specific embodiment, the firebox preferably has a width of fourteen inches, a depth from front to rear of fourteen inches and a uniform height of ten inches.

Air supply unit 20 can be disposed on either side of the firebox to draw in room or outside air, as desired, and blower 22 is preferably a thirty cubic feet per minute blower suitable for such purposes. Manifold tube 26 preferably is made from steel and has a rectangular cross-sectional configuration measuring two inches by one inch. It is preferred that channel 28 be made from steel and that the vertical dimension of the channel equal the vertical dimension of tube 26 to enable the firebox to be supported via tube 26 and channel 28 in a level, horizontally oriented position upon the floor of a fireplace or stove. Deflector 36 and baffle 38 are also preferably fashioned from steel, and the deflector 36, baffle 38, tube 26 and channel 28 are joined to the firebox by welding.

In operation, the apparatus 10 is placed in a stove or fireplace with the open top of the firebox 12 aligned with the flue or chimney, as shown in FIG. 1. A stack of newspapers 42, three to six inches high, having their free edges in general vertical alignment is centrally positioned directly on floor 16 about one half inch from the rearwardmost end of deflector 36 to be supported horizontally on floor 16. Blower 22 is started, and outside air is drawn into the blower for discharge through the blower discharge outlet into manifold tube 26. Air flowing in tube 26 is forced by baffle 38 through passage 34 for discharge into the firebox at a rate of approximately twenty five to thirty cubic feet per minute, and the newspapers can be easily lit. The continuous flow of air from passage 34 is directed by deflector 36 onto the floor 16 of the firebox, and the air stream coming from deflector 36 forms an angle A of approximately twenty five degrees with respect to the floor. Air directed onto floor 16 flows around all of the sides of the newspaper stack, and this air rises around the sides, or face, of the stack as air continues &:o enter the firebox. This flow of air causes the outer surface, or face, of the stack to burn, because air does not reach the inside of the stack and because burning along the face of the stack produces a very hot, outer, semi-solid coating further inhibiting burning in the interior of the stack. The stack, therefore, burns slowly from the outside to the inside, and a stack of newspapers three to six inches high can burn for up to three hours with very little smoke and maximum radiant heat convection. The air stream continuously directed toward floor 16 by deflector 36 sweeps ashes off the floor and eliminates the accumulation of ash or residue that might otherwise smother the fire, and the entire stack can be burned completely without the need for relighting or further attention.

Having described a preferred embodiment of a new and improved method and apparatus for burning stacked newspapers constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. Apparatus for burning flat newspaper sheets vertically aligned to form a stack in a fireplace or stove comprising receptacle means positionable in a fireplace and having floor means for supporting the stack of newspapers in a horizontal orientation on said floor means for burning in said receptacle means; and air supply means for directing a flow of air onto said floor means to flow around the stack of newspapers and obtain burning of the outer surface of the stack of newspapers.

2. Apparatus for burning stacked newspapers in a fireplace or stove as recited in claim 1 wherein said air supply means includes air blower means for drawing in air from outside said receptacle means, means in communication with said air blower means for carrying air drawn in by said air blower means, means in communication with said air carrying means for discharging a stream of air from said air carrying means into said receptacle means and means positioned over said discharge means for deflecting air discharged by said discharge means onto said floor means.

3. Apparatus for burning stacked newspapers in a fireplace or stove as recited in claim 2 wherein said air carrying means includes a manifold tube mounted beneath said floor means.

4. Apparatus for burning stacked newspapers in a fireplace or stove as recited in claim 3 wherein said discharge means includes a first opening in said manifold tube and a second opening in said floor means in vertical alignment with said first opening.

5. Apparatus for burning stacked newspapers in a fireplace or stove as recited in claim 4 wherein said deflector means is mounted in said discharge means.

6. Apparatus for burning stacked newspapers in a fireplace or stove as recited in claim 5 wherein said deflector means includes a curved body positioned over said second opening to direct air discharged by said discharge means onto said floor means.

7. Apparatus for burning stacked newspapers in a fireplace or stove as recited in claim 6 wherein said curved body defines an arc of a circle having a center disposed on said floor means and a radius contained in a plane perpendicularly intersecting said floor means.

8. Apparatus for burning stacked newspapers in a fireplace or stove as recited in claim 7 wherein said receptacle means includes a firebox having spaced side walls and a rear wall extending perpendicularly upwardly from said floor means.

9. Apparatus for burning stacked newspapers in a fireplace or stove as recited in claim 8 wherein said floor means includes a horizontally oriented floor joined to said side walls and said rear wall.

10. Apparatus for burning stacked newspapers in a fireplace or stove as recited in claim 9 wherein said floor means defines a front edge extending laterally between said side walls and said manifold tube extends laterally between said side walls adjacent said front edge.

11. Apparatus for burning stacked newspapers in a fireplace or stove as recited in claim 10 further including channel means mounted beneath said floor means for permitting said floor means to be supported by said manifold tube and said channel means in a horizontal orientation in a fireplace or stove.

12. Apparatus for burning stacked newspapers in a fireplace or stove as recited in claim ll wherein said first and second openings are disposed adjacent said front edge to be centrally positioned between said side walls.

13. Apparatus for burning stacked newspapers in a fireplace or stove as recited in claim 12 wherein said deflector means directs air onto said floor means to form an acute angle with said floor means.

14. Apparatus for burning stacked newspapers in a fireplace or stove as recited in claim 13 wherein said acute angle is approximately twenty-five degrees.

15. Apparatus for burning stacked newspapers in a fireplace or stove as recited in claim 14 wherein said blower means includes a thirty cubic feet per minute blower.

16. A method of burning flat newspaper sheets vertically aligned to form a stack in a firebox in a fireplace or stove comprising the steps of positioning the stack of newspapers on the floor of the firebox to be supported in a horizontal orientation; and directing a flow of air onto the floor of the firebox at a position forwardly spaced from and laterally centered on one of the vertical sides of the stack to flow around the stack and obtain burning of the outer surface of the stack.

17. A method of burning a stack of newspapers in a firebox as recited in claim 16 wherein said step of directing includes angularly directing said flow of air to form an acute angle with the floor of the firebox.

18. A method of burning a stack of newspapers in a firebox as recited in claim 17 wherein said acute angle is approximately twenty-five degrees.

19. A method of burning a stack of newspapers in a firebox as recited in claim 18 wherein said step of directing includes directing said flow of air at a rate of twenty-five to thirty cubic feet per minute.

20. A method of burning a stack of newspapers in a firebox as recited in claim 19 wherein said step of positioning includes centrally positioning a stack of newspapers three to six inches in height on the floor of the firebox.

* * * * *